United States Patent [19]

Hu

[11] Patent Number: 4,913,364

[45] Date of Patent: Apr. 3, 1990

[54] TOILET PAPER CASE WITH A ROTATABLE COVER PLATE

[76] Inventor: Dye-Chung Hu, No. 172, Hsin-Hsing Rd., Pei-Tun Dist., Taichung City, Taiwan

[21] Appl. No.: 347,502

[22] Filed: May 4, 1989

[51] Int. Cl.[4] ..... B65H 19/00; B65H 35/10

[52] U.S. Cl. ..... 242/55.2; 242/55.33; 225/43; 225/46

[58] Field of Search ..... 242/55.2, 55.3, 55.53; 206/408; 225/43, 46; 312/37, 38, 39; D6/522, 523

[56] References Cited

U.S. PATENT DOCUMENTS

| | | | |
|---|---|---|---|
| 1,003,995 | 9/1911 | Denoon, Jr. | 242/55.53 |
| 1,122,673 | 12/1914 | Winter et al. | 312/39 X |
| 1,953,349 | 4/1934 | Jaruis | 225/46 |
| 2,487,763 | 11/1949 | Patterson et al. | 242/55.53 |
| 3,319,855 | 5/1967 | Tucker et al. | 312/39 X |
| 3,333,909 | 8/1967 | Beker | 225/43 |
| 3,494,518 | 2/1970 | Goss | 312/39 X |
| 4,099,681 | 7/1978 | House | D6/523 X |
| 4,832,271 | 5/1989 | Geleziunas | 242/55.53 |

*Primary Examiner*—Stuart S. Levy
*Assistant Examiner*—Eric P. Dunlap
*Attorney, Agent, or Firm*—Jeffers, Hoffman & Niewyk

[57] ABSTRACT

A toilet paper case includes a generally U-shaped housing which has a base mounting segment and two side segments. The housing is opened at the top, front and bottom sides thereof. The side segments are formed in the upper end portions thereof with open-ended vertical slide slots in which two ends of a reel are received slidably. A generally L-shaped cover plate is hinged to the front end portions of the side segments and has a generally horizontal portion covering the top side of the housing, and a generally vertical portion covering the front side of the housing. The rear end of the cover plate rests on the upper end of the base mounting segment and cannot be turned down. The cover plate has a forked lower end which includes serrated outer and inner edges for cutting a roll of toilet paper single handedly while mounted rotatably in the housing. A press plate is hinged to the generally horizontal portion at one end thereof and is brought in contact with the toilet paper at the other end to limit the undesirable reeling of the toilet paper during cutting.

2 Claims, 2 Drawing Sheets

TOILET PAPER CASE WITH A ROTATABLE COVER PLATE

BACKGROUND OF THE INVENTION

This invention relates to a toilet paper case, more particularly to a toilet paper case including a cover plate rotatable to open the case so that a roll of toilet paper can be wound on a reel.

A commonly used toilet paper case includes a housing mounted on a wall carrying a toilet paper reel, and a hinged cover having a serrated edge to cut the toilet paper. Such a toilet paper case suffers from the following disadvantages: (1) when one desires to take a piece of paper from the paper reel, he or she must use one hand to depress the cover plate and the other hand to cut the paper; (2) in many cases, the paper cannot be cut off properly since the paper cannot be prevented from unreeling; and (3) sometimes, the cover plate with the serrated edge, when lifted for the replacement of a paper reel, may turn down and hurt the hand of the user.

SUMMARY OF THE INVENTION

An object of this invention is to provide a toilet paper case carrying a roll of toilet paper which can be cut off using one hand.

Another object of this invention is to provide a toilet paper case carrying a roll of toilet paper which can be cut off properly without unreeling.

Still another object of this invention is to provide a toilet paper case including a rotatable cover plate having serrated edges which cannot hurt the user's hand while a paper reel is being replaced.

According to this invention, a toilet paper case includes a U-shaped housing which has a base mounting segment and two side segments. The housing is opened at the top, front and bottom sides thereof. The base mounting segment has a high outer wall portion and a low inner wall portion integrally formed with and parallel to the outer wall portion. The side segments have opposed and open-ended vertical slide slots formed in the upper end portions of the inner surfaces thereof. A toilet paper reel has two ends which are received slidably in the slide slots. A generally L-shaped cover plate has a generally horizontal portion and a generally vertical portion and is hinged to the front end portions of the side segments at the juncture between the generally horizontal portion and the generally vertical portion so as to cover the top side and the front side of the housing with the generally horizontal portion and the generally vertical portion. The generally horizontal portion of the cover plate has a rear end which rests on the upper end of the low wall portion so that the end cannot turn down. The generally vertical portion of the cover plate has a forked lower end portion which includes a serrated inner edge and a serrated outer edge. The serrated inner edge may be an edge with a series of sharp teeth, needles or bumps or a rough edge face which can limit the unreeling of the paper. When the forked lower end of the cover plate is tipped to rotate so as to open the top side of the housing, the generally vertical portion of the cover plate automatically pushes the reel to slide upward along the slide slots so that one may easily install or replace a toilet paper roll. In a case where the cover plate is engaged with the low wall portion of the base mounting segment, an end portion of the toilet paper may be pulled downward out of the housing and then pulled forward so as to be cut with the forked lower end portion of the cover plate. The generally horizontal portion of the cover plate includes a press plate hinged thereto at one end of the press plate. The other end of the press plate rests on the toilet paper in front of the slide slots so as to limit the undesirable reeling of toilet paper during cutting.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
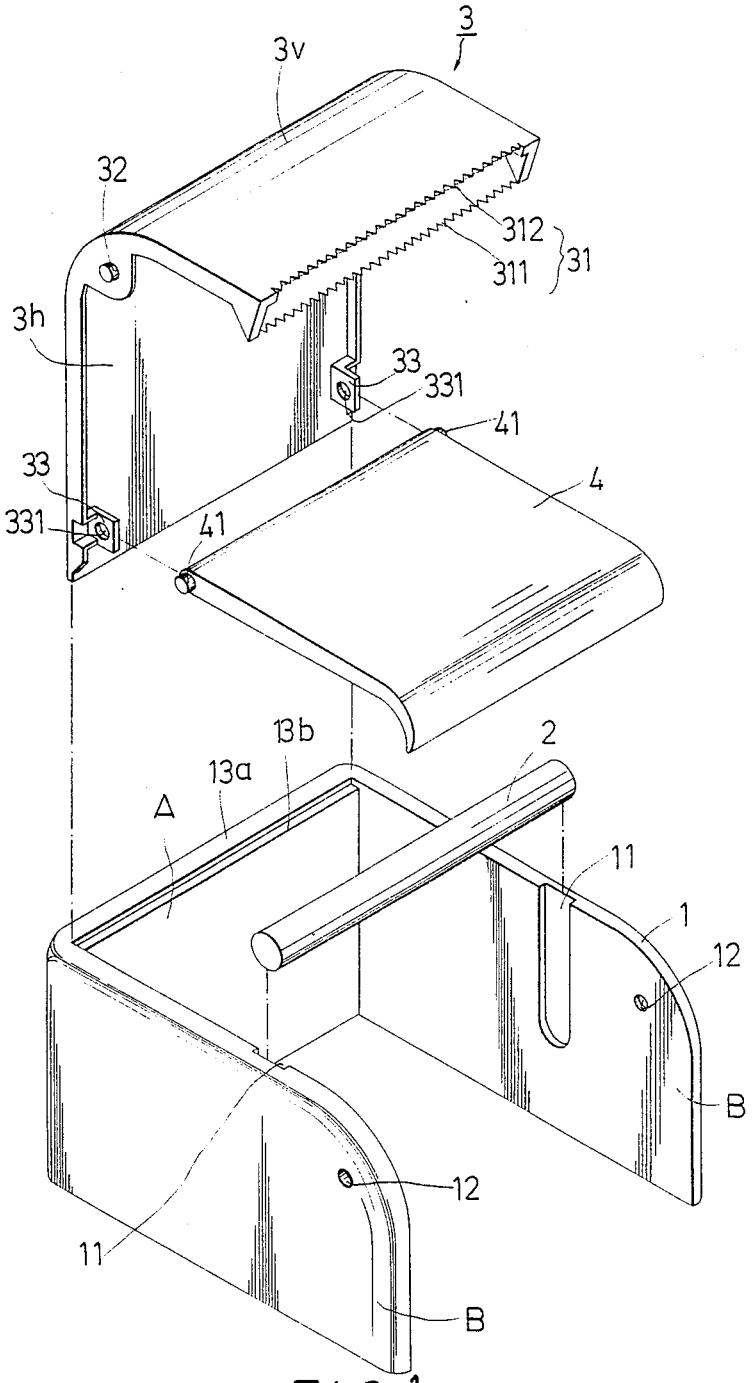
FIG. 1 is an exploded view of a toilet paper case according to this invention.
Figure 2:
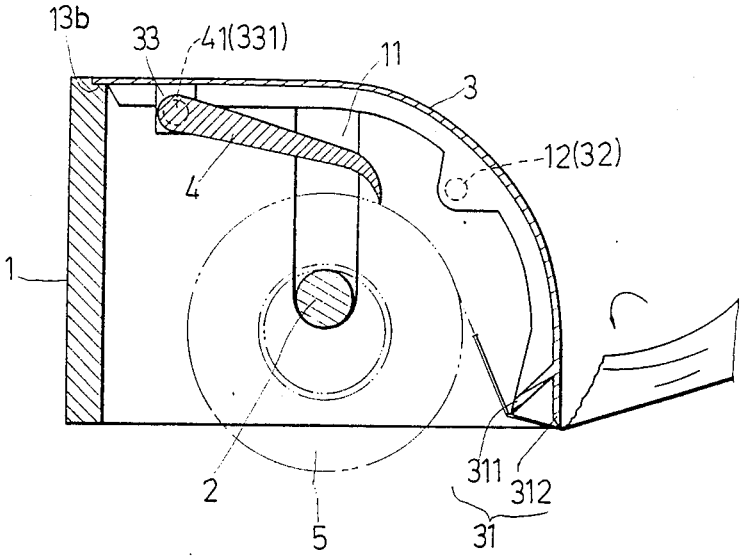
FIG. 2 is a schematic view illustrating how to cut a roll of toilet paper off in accordance with this invention.

Referring to FIGS. 1 and 2, a toilet paper case of this invention includes a generally U-shaped housing 1, a toilet paper reel 2, a generally L-shaped cover plate 3 and a press plate 4.

The housing 1 has a base mounting segment A and two side segments B and is opened at the top, front and bottom sides thereof. The side segments B have opposed and open-ended vertical slide slots 11 formed in the upper end portions of the inner surfaces thereof, and opposed holes 12 formed in the front end portions of the side segments B. The base mounting segment A has a high outer wall portion **13*a* and a low inner wall portion 13*b* integrally formed with and parallel to the outer wall portion. The reel 2 has two ends which are received slidably in the slide slots 11 of the side segments B. A roll of toilet paper 5 is wound on the reel 2**.

The cover plate 3 has a generally horizontal portion **3*h* and a generally vertical portion 3*v* having a forked lower end portion 31 which includes a serrated inner edge 311 and a serrated outer edge 312. Two pivot pins 32 are provided on the side surfaces of the cover plate 3 between the generally horizontal portion 3*h* and the generally vertical portion 3*v* and are engaged rotatably with the holes 12 of the side segments B. Two lugs 33 are provided on the underside of the generally horizontal portion 3*h* and have aligned holes 331 through which the pivot pins 41 of the press plate 4 are passed. The top and front sides of the housing 1 are sealed by the generally horizontal portion 3*h* and the generally vertical portion 3*v* of the cover plate 3. The generally horizontal portion 3*h* has a rear end which rests on the upper end of the low wall portion 13*b* so that the rear end cannot turn down. The free end of the press plate 4 rests on the toilet paper 5 in front of the slide slots 11 so as to limit the undesirable reeling of the toilet paper 5** during cutting.

Because the cover plate 3 is normally engaged with the upper end of the low wall portion **13*b*, when an end portion of toilet paper 5 is pulled downward out of the housing, the cover plate 3 cannot rotate and the toilet paper 5 can be pulled again forward so as to be cut with the forked lower end portion 31 of the cover plate 3, as illustrated in FIG. 2**.

Figure 3:
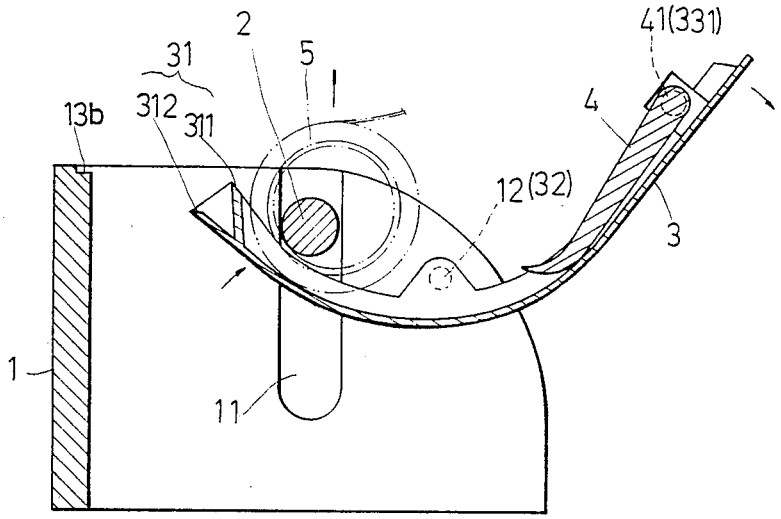
FIG. 3 is a schematic view illustrating how to mount a roll of toilet paper on a reel in accordance with this invention.

Referring to FIG. 3, When the forked lower end 31 of the cover plate 3 is tipped to rotate so as to open the top side of the housing 1, the generally vertical portion 3v of the cover plate 3 automatically pushes the reel 2 to slide upward along the slide slots 11 so that the toilet paper 5 can be replaced.

With this invention thus explained, it is apparent that numerous modifications and variations can be made without departing from the scope and spirit of this invention. It is therefore intended that this invention be limited only as indicated in the appended claims.

I claim:

1. A toilet paper case comprising:

a U-shaped housing having a base mounting segment and two side segments and opened at a top side, a front side and a bottom side thereof, said base mounting segment having a high outer wall portion and a low inner wall portion integrally formed with and parallel to said outer wall portion, said side segments having opposed and open-ended vertical slide slots formed in upper end portions of inner surfaces thereof;

a toilet paper reel having two ends which are received slidably in said slide slots; and a generally L-shaped cover plate having a generally horizontal portion and a generally vertical portion and hinged to front end portions of said side segments at a juncture between said generally horizontal portion and said generally vertical portion so as to cover said top side and said front side of said housing with said generally horizontal portion and said generally vertical portion, said generally horizontal portion of said cover plate having a rear end which rests on an upper end of said low wall portion so that said rear end cannot turn down, said generally vertical portion of said cover plate having a forked lower end portion which includes a serrated inner edge and a serrated outer edge, the serrated inner edge may be an edge with a series of sharp teeth, needles or bumps or a rough edge face which can limit the unreeling of the paper;

wherein, when said forked lower end of said cover plate is tipped to rotate so as to open said top side of said housing, said generally vertical portion of said cover plate automatically pushes said reel to slide upward along said slide slots so that a roll of toilet paper can be mounted on said reel; in a case where said cover plate is engaged with said low wall portion of said base mounting segment, an end portion of said toilet paper may be pulled downward out of said housing and then pulled forward so as to be cut with said forked lower end portion of said cover plate.

2. A toilet paper case as claimed in claim 1, wherein said generally horizontal portion of said cover plate includes a press plate hinged thereto at one end of said press plate, the other end of said press plate resting on said toilet paper in front of said slide slots so as to limit the undesirable reeling of said toilet paper during cutting.

* * * * *